United States Patent [19]

Gee et al.

[11] 4,015,348

[45] Apr. 5, 1977

[54] RIPPER ASSEMBLY FOR TRACTOR DRAWN SCRAPER

[75] Inventors: James E. Gee, Washington; Robert N. Stedman, Chillicothe, both of Ill.

[73] Assignee: Caterpillar Tractor Co., Peoria, Ill.

[22] Filed: Sept. 30, 1975

[21] Appl. No.: 618,181

[52] U.S. Cl. ..... 37/124; 37/129; 37/DIG. 3; 37/117.5; 172/697

[51] Int. Cl.[2] ..... E02F 5/04

[58] Field of Search ..... 37/124, 126 R, 129, 37/DIG. 3, DIG. 12, 117.5, 8; 172/784, 785, 317, 318, 297, 300–301, 304, 687, 691, 692, 694, 697, 701, 734, 744, 763

[56] References Cited

UNITED STATES PATENTS

| | | | |
|---|---|---|---|
| 703,168 | 6/1902 | Asplen | 172/687 X |
| 1,252,627 | 1/1918 | Strack | 172/744 X |
| 1,842,268 | 1/1932 | Holmgren | 172/697 |
| 2,686,982 | 8/1954 | Leliter | 172/784 |
| 2,745,328 | 5/1956 | Brimhall | 37/129 X |
| 2,840,933 | 7/1958 | Brem | 37/DIG. 12 |
| 2,984,026 | 5/1961 | Thompson et al. | 172/784 X |
| 3,319,366 | 5/1967 | Thompson | 172/785 |
| 3,541,709 | 11/1970 | Comer, Jr. et al. | 37/141 R X |
| 3,893,516 | 7/1975 | Zimmerman | 172/797 X |

*Primary Examiner*—E. H. Eickholt
*Attorney, Agent, or Firm*—Phillips, Moore, Weissenberger, Lempio & Majestic

[57] ABSTRACT

The invention is concerned with an improvement in a tractor drawn scraper wherein the scraper has a bowl with a back, a bottom, two sides and a forward cutting edge and a spreader forward of the cutting edge and supported by forward extensions of the bowl sides. A tractor is provided forward of the spreader for pulling the scraper and means are provided for raising and lowering the forward end of the scraper relative to the tractor. The improved ripper assembly of the present invention comprises a beam suspended generally vertically downwardly from the spreader and forwardly from the bowl, the beam having a plurality of ripper sockets extending laterally from it. Held within the ripper sockets are a plurality of ripper shanks. A plurality of ripper teeth are generally provided proceeding from the ripper shanks. Means are provided for adjusting the vertical separation between the beam and the spreader.

6 Claims, 4 Drawing Figures

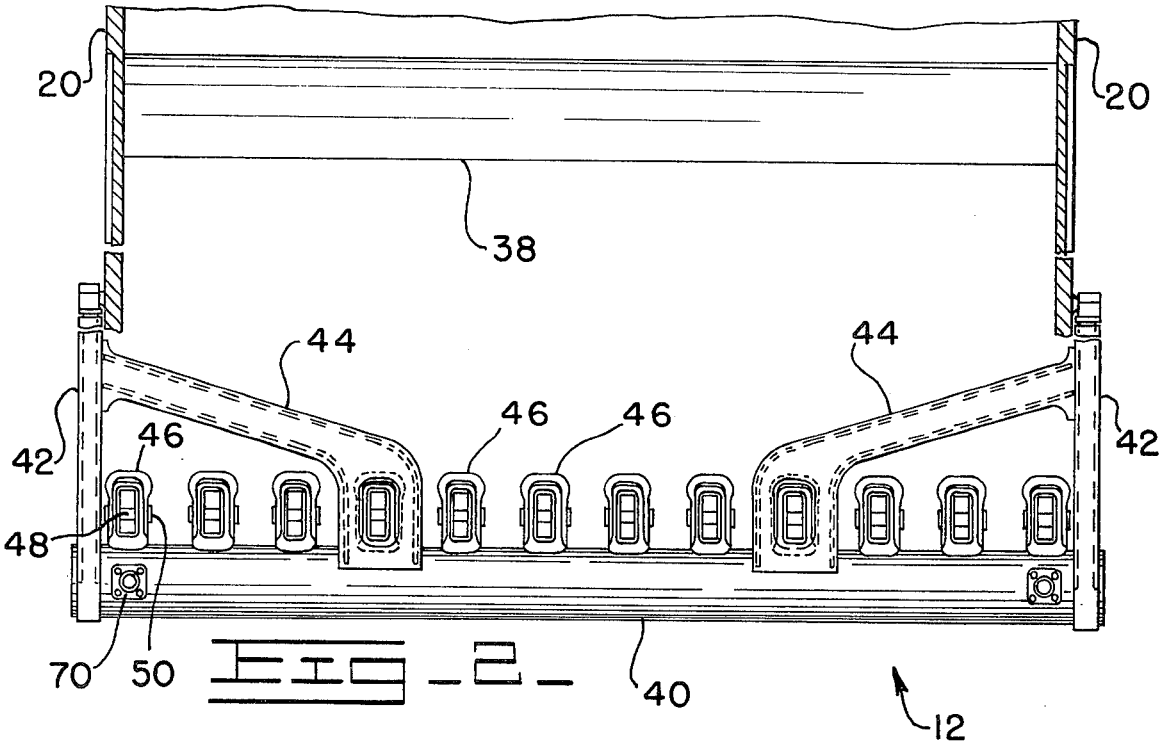
Fig. 2
Fig. 3
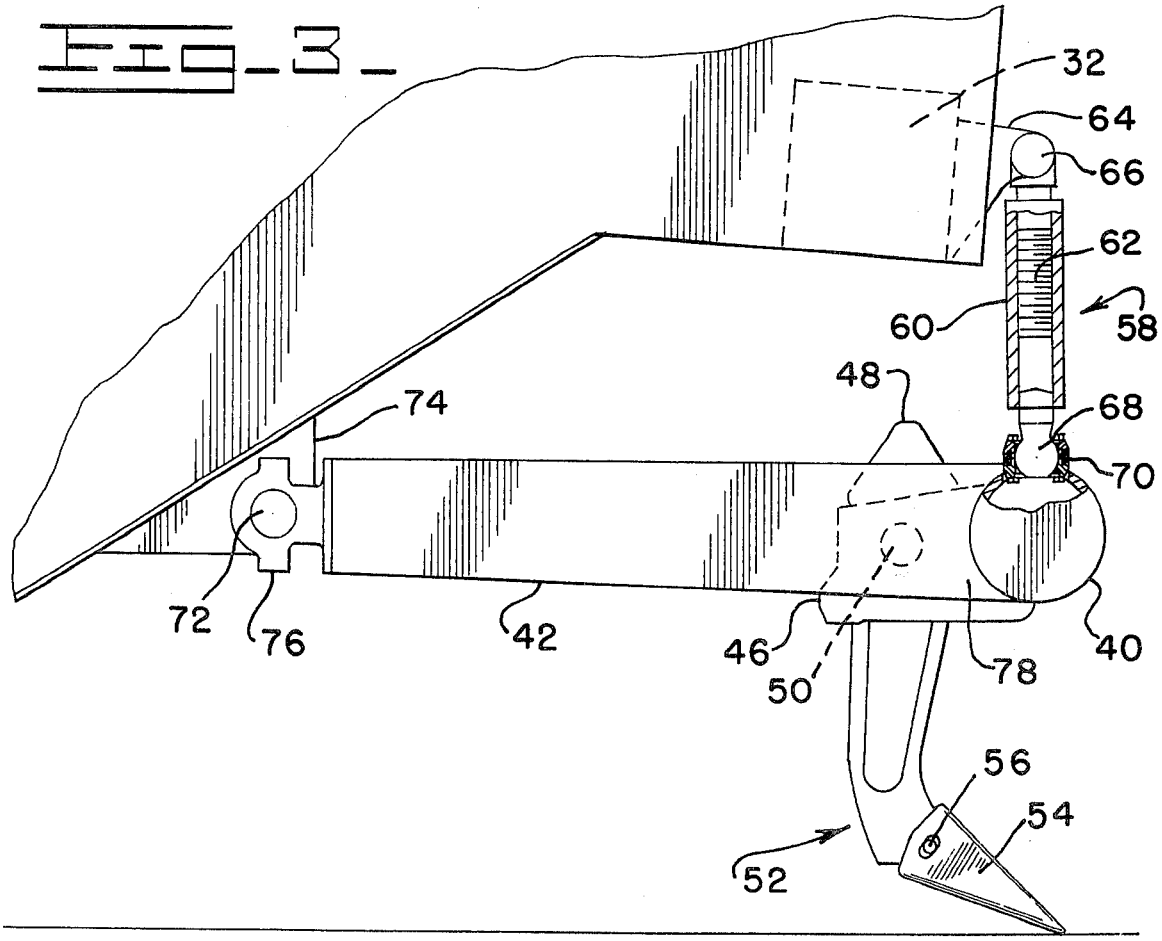

RIPPER ASSEMBLY FOR TRACTOR DRAWN SCRAPER

BACKGROUND OF THE INVENTION

1. Field of the Invention

The invention is concerned with earth working machines and more particularly with scrapers which are pulled by tractors. More particularly the invention is concerned with an improvement in such an earth working machine in the form of a beam suspended generally vertically from the spreader and forwardly from the bowl, the beam supporting ripper sockets and means for adjusting the vertical separation between the beam and the spreader whereby ripper teeth extending from ripper shanks held within the ripper sockets can be adjusted to contact the ground at a desired angle and separation from the bottom of the scraper bowl. Such an arrangement has been found to be particularly useful with self loading auger scrapers.

2. Prior Art

The prior art discloses a number of scraper-tractor combinations wherein the tractor pulls the scraper and wherein a ripper assembly is supported by the tractor as for example in the road-working machine disclosed in U.S. Pat. No. 2,984,026 or is supported by the draft arms which connect the tractor to the scraper as for example in the apparatus shown in U.S. Pat. No. 2,745,328. When the ripper assembly is supported by the tractor, said ripper assembly generally does not travel up and down along with the forward end of the scraper. Thus, a correlation between the positioning of the cutting edge of the scraper and the ripper assembly is not automatically obtained with up and down movement of the spreader. Similarly, when the ripper assembly is carried by the draft arms which connect the scraper to the tractor the ripper assembly does not travel up and down along with the spreader. Thus, the positioning between the ripper assembly and more particularly between the teeth of the ripper assembly and the cutting edge of the scraper is not geometrically fixedly related. Further, in such assemblies as are mentioned above, strongly triangulated support for the ripper assembly is not provided and thus the ripper assemblies are subject to damage during heavy earth moving usage.

The present invention is particularly concerned with a ripper assembly which is supported both by a spreader at the forward end of a scraper and by the sides of the bowl of a scraper whereby triangulated support is provided for the ripper assembly and whereby also the ripper assembly travels up and down along with the forward end of the scraper (along with the spreaders so that the cutting edge of the scraper and the ripper assembly are geometrically placed in a selectively determinable manner relative to one another. Advantages attained are added strength and added coordination of ripper assembly-cutting edge operation.

SUMMARY OF THE INVENTION

The invention is concerned with an improvement in an earth working machine which machine comprises a scraper having a bowl, a back, a bottom, two sides and a forward cutting edge, a spreader forward of the cutting edge and supported by forward extensions of the sides, a tractor forward of the spreader for pulling the scraper and means for raising and lowering a forward end of the scraper relative to the tractor. The improvement comprises a ripper assembly comprising a beam suspended generally vertically downwardly from the spreader and forwardly from the bowl, the beam having a plurality of ripper sockets extending laterally therefrom. A plurality of ripper shanks are held in the sockets and means are provided for adjusting the vertical separation between the beam and the spreader.

BRIEF DESCRIPTION OF THE DRAWINGS

The invention will be better understood by reference to the Figures of the drawings wherein like numbers denote like parts throughout and wherein:

FIG. 2 illustrates a view taken from the plane II — II of FIG. 1;

FIG. 3 illustrates a partial side elevational view partially in section of the ripper assembly of the present invention.

DETAILED DESCRIPTION OF THE PREFERRED EMBODIMENT

Figure 1:
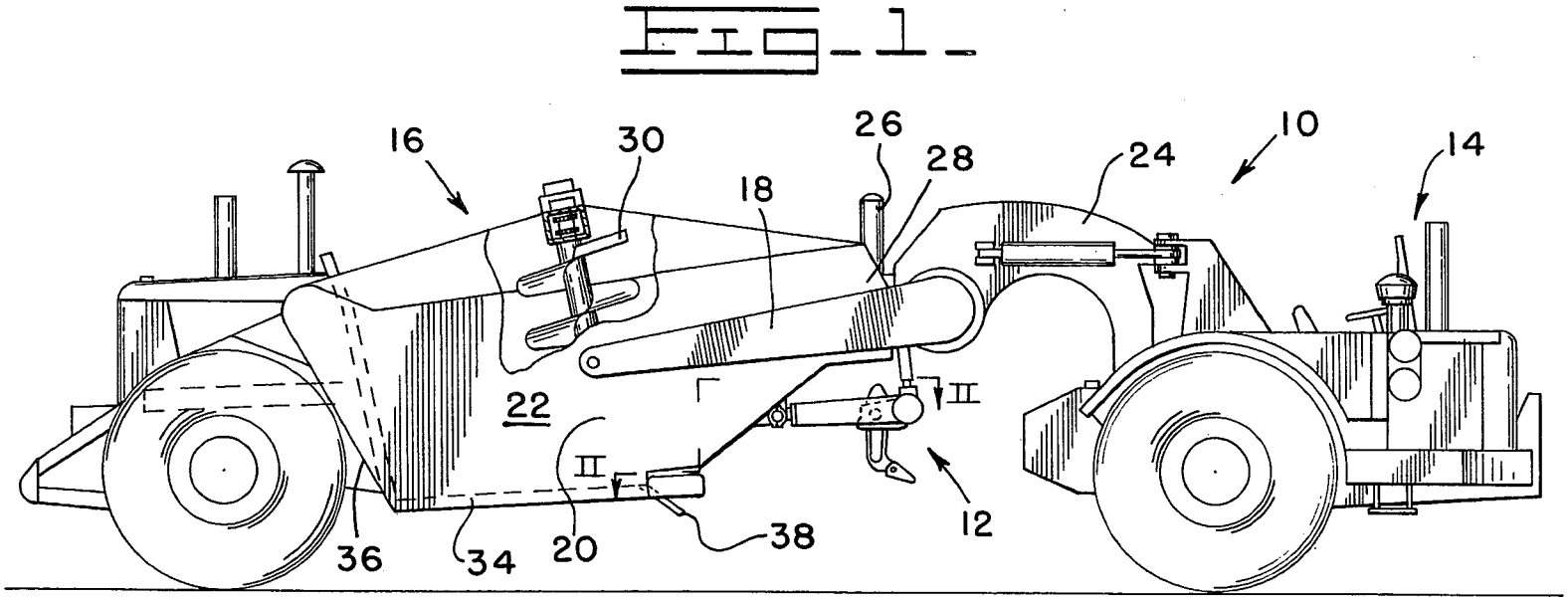
FIG. 1 illustrates an earth working machine including the ripper assembly of the present invention with the scraper having its forward end raised above the ground.
Figure 4:
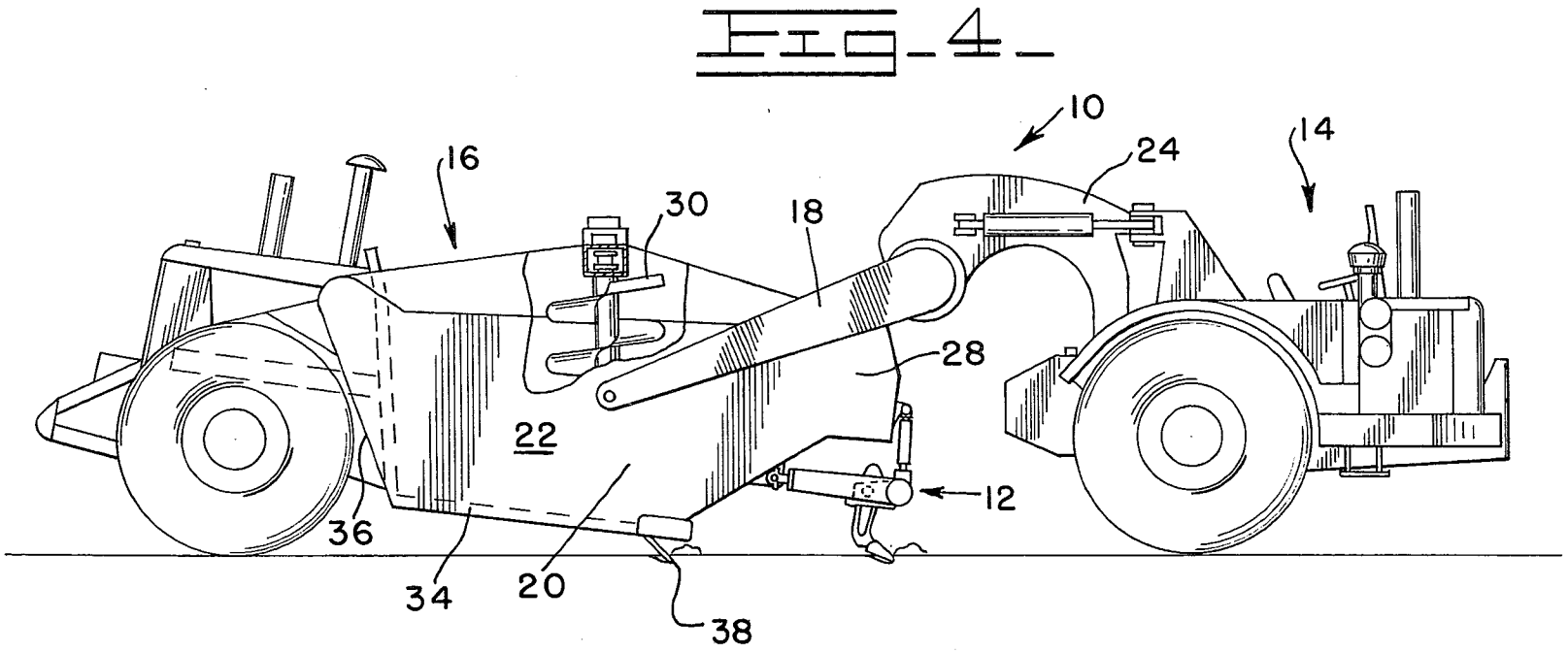
FIG. 4 illustrates an earth working machine of the present invention in operation ripping, cutting and scraping soil into a scraper bowl.

An earth working machine 10 is illustrated in FIGS. 1 and 4, said earth working machine 10 including an improved ripper assembly 12 of the present invention as illustrated in more detail in FIGS. 2 and 3. The earth working machine 10 includes a tractor 14 and a scraper 16, the tractor including a usual cab with controls therein for operator direction thereof. The tractor illustrated is a wheel type tractor which is connected to and pulls the scraper 16 through use of a pair of draft arms 18, each of which is rotatingly attached at one end to the scraper 16 and more particularly to one of a pair of sides 20 of the bowl 22 of the scraper 16 and on the other end thereof to a goose neck 24 which extends from the tractor 14. A lift cylinder 26 which communicates between the goose neck 24 and a forward end 28 of the bowl 22 serves to control raising and lowering of said forward end 28 of the scraper 16 relative to the tractor 14. The illustrated scraper 16 includes therein an auger 30 which is powered whereby the scraper 16 is made self loading, i.e., whereby the dirt is pulled up by the auger 30 and backwardly into the bowl 22 of the scraper 16. At the forward end 28 of the scraper 16 is a spreader 32 which is supported on its ends by the forward extensions 28 of the sides 20 of the bowl 22. The spreader 32 is the preferred embodiment of the invention serves a very important purpose in that it serves as a support for the ripper assembly 12 as will be explained hereafter. The bowl 22 in the usual manner has a bottom 34 as well as a back 36. At the forward end of the bottom 34 of the bowl 22 is a cutting edge 38 which stretches generally from one of the sides 20 of the bowl 22 to the other of the sides 20 thereof.

Turning now to the ripper assembly 12 proper and most particularly to FIGS. 2 and 3, it is seen that the ripper assembly 12 includes a beam 40 supported at each end by one pair of arms 42. A pair of gussets 44 are provided between the arms 42 and the beam 40 to give added strength thereto via generally triangular bracing thereof. The beam 40 is suspended generally vertically downwardly from the spreader 32 and generally forwardly via the arms 42 from the bowl 22. A plurality of ripper sockets 46 extend laterally from the beam 40 generally towards the bowl 22. Within each of the ripper sockets 46 there is positioned a ripper shank 48 held in position by a pin 50. With a ripper shank 48 in place within a ripper socket 46, a lower end 52 of the ripper shank 48 extends downwardly from the beam 40 towards the ground. Generally there is attached to the lower end 52 of the ripper shank 48 a tooth 54 which is generally replaceably attached to the lower end 52 of the ripper shank 48 by a pin 56. The ripper teeth 54 serve to dig into earth as the scraper 16 is pulled forwardly by the tractor 14 with the forward extension 28 of the sides 20 of the scraper 16 and hence with the entire forward end of the scraper 16 positioned downwardly through action of the lift cylinder 26. Generally, the ripper sockets 46 are spaced linearly along the beam 40 with the outermost of said ripper sockets 46 being in approximate alignment with the outer ends of the cutting edge 38 and of the bowl 22. In this manner, the cutting edge 38 acts only upon preripped ground.

The vertical relationship between all of the teeth 54 and the cutting edge 38 is adjustable via means for adjusting the vertical separation between the beam 40 and the spreader 32. Thus, the heights of each of the teeth 54 do not need separate adjustment. In the embodiment illustrated such vertical separation adjustment is accomplished by telescoping means 58 which comprise a pair of internally threaded cylinders 60 with a pair of mating externally threaded post 62 therewithin, the posts 62 being attached to the spreader 32 via a pair of gussets 64 and a pair of fittings 66. Each cylinder 60 is generally rotatingly attached to the beam 40 as via a ball 68 within a socket 70 which is attached directly to the beam 40. The arms 42 are generally pivotally attached to the sides 20 of the bowl 22 as for example through attachment to a pair of axles 72, which axles 72 are held in place relative to the bowl 22 by a pair of support members 74. Thus, it will be seen that the overall means for adjusting the vertical separation between the beam 40 (and hence all of the teeth 54) and the spreader 32 comprises the telescoping means 58 which are pivotally attached to one of the beam 40 and the spreader 32, and the pair of arms 42 which are pivotally attached at a first end 76 thereof to each side of the bowl 22 and are attached at a second end 78 thereof to the beam 40 generally at an end of said beam 40.

OPERATION

The operation of the earth working machine of the present invention is relatively straightforward. First, the ripper assembly is adjusted to a desired height whereby the teeth 54 are at a desired relative height compared to the cutting edge 38 as by adjusting the length of the telescoping means 58 through loosening or tightening the cylinder 60 on the post 62. The ball 68 and the socket 70 provide play for this adjustment as do the axles 72 to which the first end 76 of the arms 42 are attached. An operator then proceeds to run the tractor 14 forwardly while controlling at the same time the height of the forward extension 28 and thus of the entire forward end of the scraper 16 relative to the tractor 14 through operation of the lift cylinder 26. The auger 30 operates as the scraper 16 is pulled forwardly by the tractor 14 to pull dirt up into the bowl 22 and most particularly up into the bowl 22 adjacent the back 36 of the bowl 22. The teeth 54 are replaceable with wear and the entire ripper assembly 12 has great strength because of the triangulation achieved by the forward extension 28 of the sides 20 along with the arms 42 and the telescoping means 58. The gussets 44 serve to provide extra strength still for the ripper assembly and the ripper sockets 46 are fixedly attached thereto in the preferred embodiment as by being welded to the beam 40. Thus the apparatus provides easy and positive operation through coordinated lifting and lowering of the ripper teeth 54 with the scraper 16 while maintaining great strength through the above mentioned triangular bracing.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. In an earth working machine which comprises a scraper having a bowl with a back, a bottom, two sides and a forward cutting edge, a spreader forward of said cutting edge and supported by forward extensions of said sides, a tractor forward of said spreader for pulling said scraper and means for raising and lowering a forward end of said scraper relative to said tractor, a ripper assembly which raises and lowers in fixed relation to said spreader and to said cutting edge on operation of said raising and lowering means comprising:

a beam suspended generally vertically downwardly from said spreader and generally forwardly from said bowl;

a plurality of ripper sockets extending laterally from said beam;

a plurality of ripper shanks held in said sockets;

a means for adjusting the vertical separation between said beam and said spreader;

a pair of telescoping means between said beam and said spreader pivotally attached to a respective one of said beam and said spreader; and a pair of arms, each pivotally attached at a first end thereof to a respective side of said bowl and attached at a second end thereof to said beam generally at an end thereof, said pair of arms, sides of said bowl and a pair of telescoping means forming a pair of triangular braces for said ripper assembly.

2. A ripper assembly as in claim 1, wherein said telescoping means each comprise an internally threaded cylinder and a mating externally threaded post.

3. A ripper assembly as in claim 2, including a pair of gussets one extending between each of said arms and said beam.

4. A ripper assembly as in claim 3, wherein said sockets are spaced linearly along said beam with the outermost of said sockets being in approximate alignment with the outer edges of said bowl.

5. A ripper assembly as in claim 4, wherein said scraper is made self-loading by including a powered auger within said bowl.

6. A ripper assembly as in claim 4, including a plurality of ripper teeth one attached to each of said ripper shanks at a lower end thereof and extending forwardly therefrom.

* * * * *